US006753818B2

(12) United States Patent
Wang

(10) Patent No.: US 6,753,818 B2
(45) Date of Patent: Jun. 22, 2004

(54) CONCEALED ANTENNA FOR MOBILE COMMUNICATION DEVICE

(75) Inventor: Wang Nang Wang, Bath (GB)

(73) Assignee: Arima Optoelectronics Corp., Taoyuan (TW)

( * ) Notice: Subject to any disclaimer, the term of this patent is extended or adjusted under 35 U.S.C. 154(b) by 91 days.

(21) Appl. No.: 10/021,666

(22) Filed: Dec. 18, 2001

(65) Prior Publication Data

US 2002/0075185 A1 Jun. 20, 2002

Related U.S. Application Data

(60) Provisional application No. 60/256,460, filed on Dec. 20, 2000.

(51) Int. Cl.[7] ..... H01Q 1/24; H01Q 1/38

(52) U.S. Cl. ..... 343/702; 343/700 MS

(58) Field of Search ..... 343/700 MS, 702, 343/828; 455/575

(56) References Cited

U.S. PATENT DOCUMENTS

| | | | | |
|---|---|---|---|---|
| 5,898,404 A | | 4/1999 | Jou | 343/700 MS |
| 5,986,609 A | | 11/1999 | Spall | 343/702 |
| 5,995,052 A | | 11/1999 | Sadler et al. | 343/702 |
| 6,054,954 A | | 4/2000 | Eggleston et al. | 343/700 MS |
| 6,061,028 A | | 5/2000 | Sakata | 343/702 |
| 6,073,027 A | | 6/2000 | Norman et al. | 455/550 |
| 6,094,179 A | | 7/2000 | Davidson | 343/895 |
| 6,140,966 A | | 10/2000 | Pankinaho | 343/700 MS |
| 6,204,826 B1 | | 3/2001 | Rutkowski et al. | 343/895 |
| 6,266,538 B1 | | 7/2001 | Waldron | 343/550 |
| 6,417,817 B1 | * | 7/2002 | Pirila et al. | 343/702 |

* cited by examiner

*Primary Examiner*—Michael C. Wilmer
(74) *Attorney, Agent, or Firm*—Volpe and Koenig, P.C.

(57) ABSTRACT

A mobile communication device comprises a housing enclosing a circuit board that has components disposed thereon. The housing has opposite first and second surfaces. An antenna element is formed on the first surface of the housing for receiving and/or transmitting electromagnetic signals. An inner conductive layer is disposed on the second surface of the housing. The inner conductive layer is electrically connected to the antenna element and in signal communication with the circuit board.

15 Claims, 12 Drawing Sheets

900 MHz

1710 MHz

1800 MHz

1900 MHz

2000 MHz

CONCEALED ANTENNA FOR MOBILE COMMUNICATION DEVICE

RELATED APPLICATIONS

The present application claims the benefit of priority from U.S. Provisional Patent Application Serial No. 60/256,460, titled "CONCEALED BACK COVER ANTENNA," filed on Dec. 20, 2000, and is related to a co-pending patent application Ser. No. 60/250,519, titled "MOBILE COMMUNICATION DEVICE HAVING MULTIPLE FREQUENCY BAND ANTENNA," filed on Dec. 4, 2000, both of which are incorporated herein by reference.

FIELD OF INVENTION

The present invention relates to a concealed antenna for mobile communication devices, and more particularly, to a concealed antenna having a novel asymmetrical structure that operates in multiple frequency bands.

BACKGROUND OF INVENTION

Mobile communication devices typically include an antenna for transmitting and/or receiving wireless communication signals. Wireless communication systems and protocols use a wide variety of frequency bands. For example, GSM (Global System for Mobile communication) is a digital mobile telephone system that typically operates at a low frequency band, such as between 880 MHz and 960 MHz. DCS (Digital Communication System) is a digital mobile telephone system that typically operates at high frequency bands between 1710 MHz and 1880 MHz. PCS (Personal Communication Services), another digital mobile telephone system, uses a band between about 1850 MHz and 1990 MHz, and GPS (Global Positioning System) uses a 1570 MHz band.

It is desirable to have the same mobile communication device working properly under these different frequencies. In order to achieve this goal, an antenna capable of transmitting and receiving signals in these frequencies has to be provided.

Concealed antennas are preferred by users of mobile communication devices, such as mobile phones, because the concealed antennas provide a compact appearance and non-intruding look. FIG. 1 shows a conventional concealed antenna used in a mobile phone. Concealed antennas usually are realized by forming radiating elements 105 on a dielectric board 110 that is concealed in the mobile phone housing.

According to FIG. 1, the antenna is disposed on the upper portion of the mobile phone housing. Disposing the concealed antenna in the upper portion of the mobile phone tends to cause interference problems. Users of mobile phones often hold the mobile phone near the upper portion of the housing. Contact by the human body usually interferes the transmission/reception quality of electromagnetic signals. In addition, placing the antenna near the upper portion of the mobile phone causes health concerns. Although impact from electromagnetic waves is not clinically proven, users prefer antennas to be as far away as possible from their heads.

Therefore, there is a need for a concealed antenna for mobile communication devices. There is another need for a concealed antenna without causing signal interference. Still another need exists for placing mobile phone antennas as far away as possible from users. These and other needs are addressed by the present invention.

SUMMARY OF THE INVENTION

The invention provides a novel design for concealed antennas used with wireless communication devices. The invention is advantageous in that the antenna is disposed in a location away from a user's head. The invention is also advantageous in reducing human contact with the antenna so that signal interference is reduced. In addition, the antenna configuration of the invention provides superior signal transmission/reception quality. The invention advantageously provides an antenna configuration that does not require a wire connecting the antenna to the circuit board of a mobile communication device.

A mobile communication device according to an embodiment of the present invention comprises a housing enclosing a circuit board that has communication components disposed thereon. The housing has opposite first and second surfaces, such as inner and outer surfaces. An antenna element is formed on the first surface of the housing for receiving and/or radiating electromagnetic signals, and an inner conductive layer is disposed on the second surface of the housing. The inner conductive layer is electrically connected to the antenna element and in signal communication with the circuit board.

In one aspect, the antenna element includes first and second radiating segments. The first radiating segment includes first and second conductive strips. The first conductive strip has a substantially L shape and is disposed along first and second sides of the housing. The second conductive strip is also of substantially L shape and has one end connected to the first conductive strip near the second side of the housing and one free end extending towards the first side of the housing.

The second radiating segment also includes third and fourth conductive strips. The third conductive strip is in of substantially L shape and disposed along the first and fourth sides of the housing. The fourth conductive strip has a substantially L shape having one end connected to the third conductive strip near the fourth side of the housing and one free end extending towards the first side of the housing.

In another aspect, the first radiating segment is sized and configured to radiate in a low frequency band and the second radiating segment is sized and configured to radiate in a high frequency band.

In still another aspect, the inner conductive layer forms electrical contact with the antenna element via metalized holes. Since the inner conductive layer is in signal communication with the circuit board, the antenna element is connected to the circuit board without using wires or strip cables.

According to another embodiment of the invention, a mobile communication device comprises a housing has a front element and a back element and encloses a circuit board having communication components disposed thereon. The front element has a display, a speaker, and a plurality of keys. A concealed antenna element is formed on the back element for receiving and/or transmitting electromagnetic signals. The concealed antenna element is formed substantially only in the bottom half of the back element. Thus, users of the mobile communication device are less likely to touch the antenna during operation.

Still other advantages of the present invention will become readily apparent from the following detailed description, simply by way of illustration of the invention and not limitation. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWINGS

The accompanying drawings, which are incorporated in and constitute a part of the specification, illustrate embodiments of the present invention and, together with the description, serve to exemplify the principles of the present invention.

DETAILED DESCRIPTION OF ILLUSTRATIVE EMBODIMENTS

Figure 1:
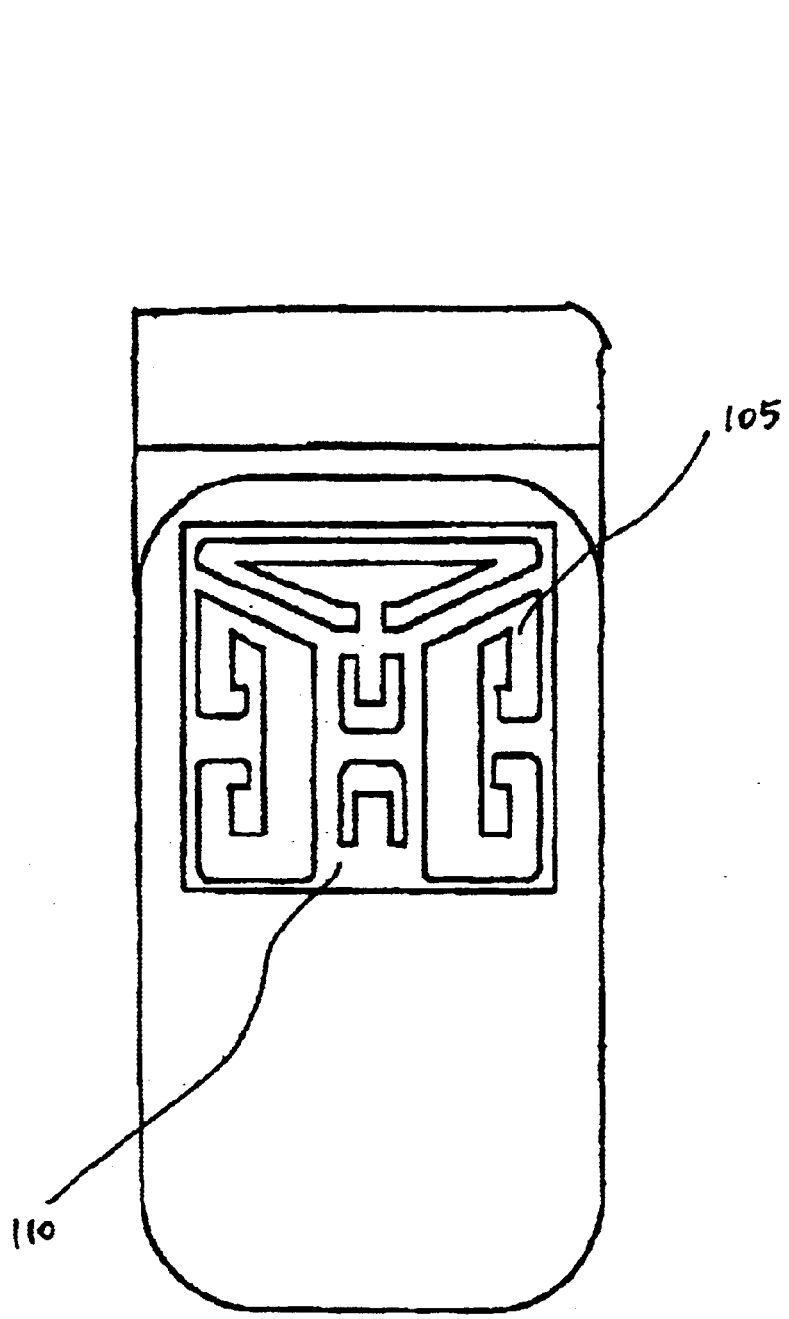
FIG. 1 (Prior Art)
FIG. 1 shows a conventional concealed antenna used in a mobile phone.
Figure 2:
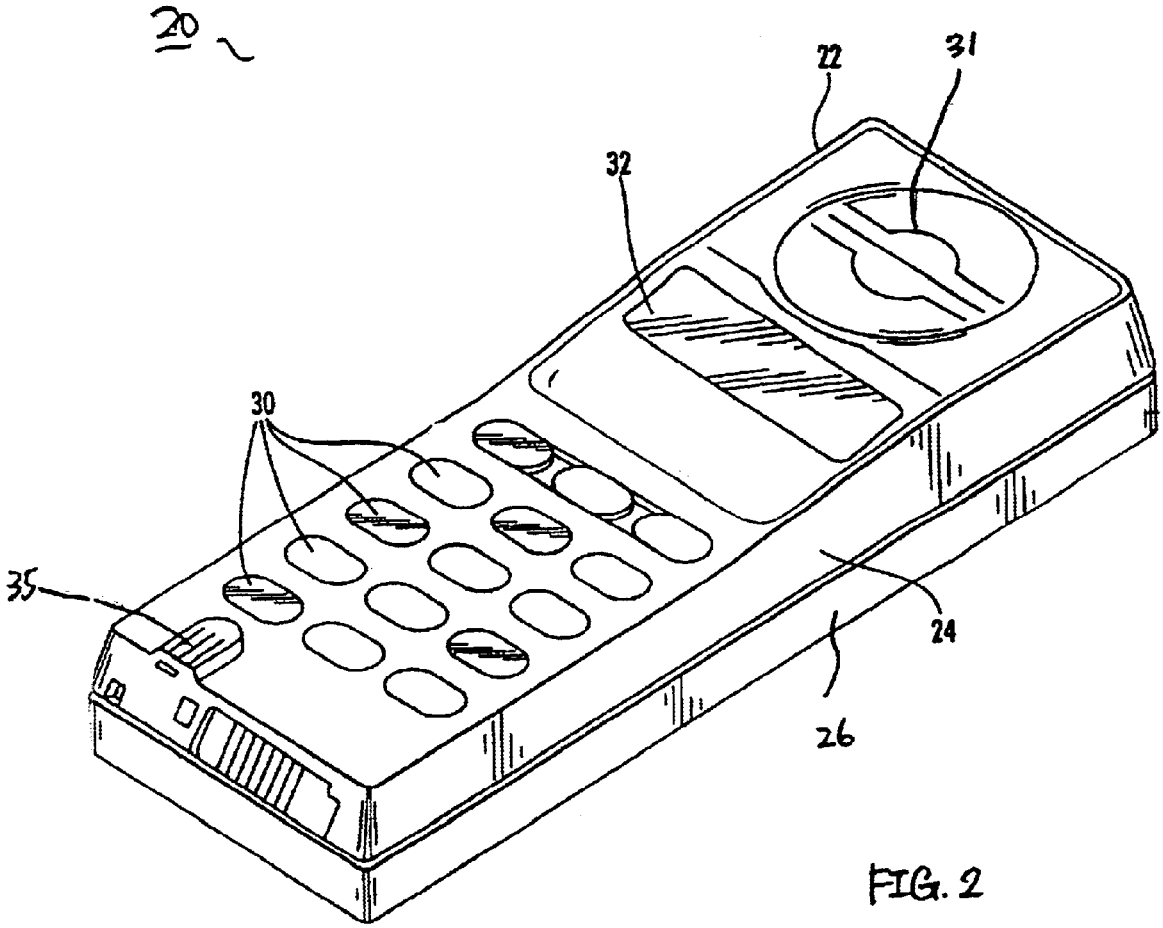
FIG. 2 depicts a mobile phone upon which the present invention may be implemented.

FIG. 2 shows a mobile phone upon which the present invention may be implemented. Mobile phone 20 includes housing 22 that bears a plurality of keys 30, a display 32, and encloses electronic components that enable mobile phone 20 to transmit and receive communications signals. Housing 22 includes an upper cover 24 and a lower cover 26, which combined encloses a circuit board (not shown) having communication components and circuits disposed thereon.

Figure 3:
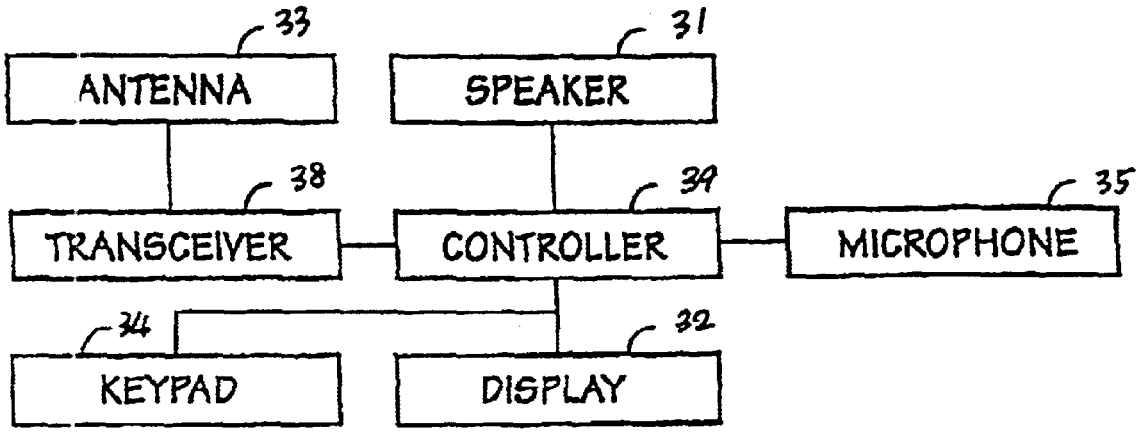
FIG. 3 is a block diagram of a mobile phone illustrated in FIG. 2.

FIG. 3 illustrates a block diagram of a mobile phone illustrated in FIG. 2. An antenna 33 for receiving and transmitting communication signals is electrically connected to a radio-frequency transceiver 38 that is in signal communication with a controller 39. Controller 39 is configured to process signals received or to be sent by the antenna 33. Controller 39 is coupled to a speaker 31 that transmits an audible signal from the controller 39 to a user of the communication device. The controller 39 is also in signal communication with a microphone 35 that receives a voice signal from a user and transmits the voice signal to the controller 39. Controller 39 is electrically connected to input keys 30 of keypad 34 and display 32 that facilitate operation of the mobile phone 20.

In order to maximize power transfer between the antenna and the transceiver, the transceiver and the antenna are preferably interconnected such that their respective impedance are substantially "matched," i.e., electrically tuned to filter out or compensate for undesired antenna impedance components to provide a desired impedance value at the feed point, such as 50 Ohms.

Figure 4A:
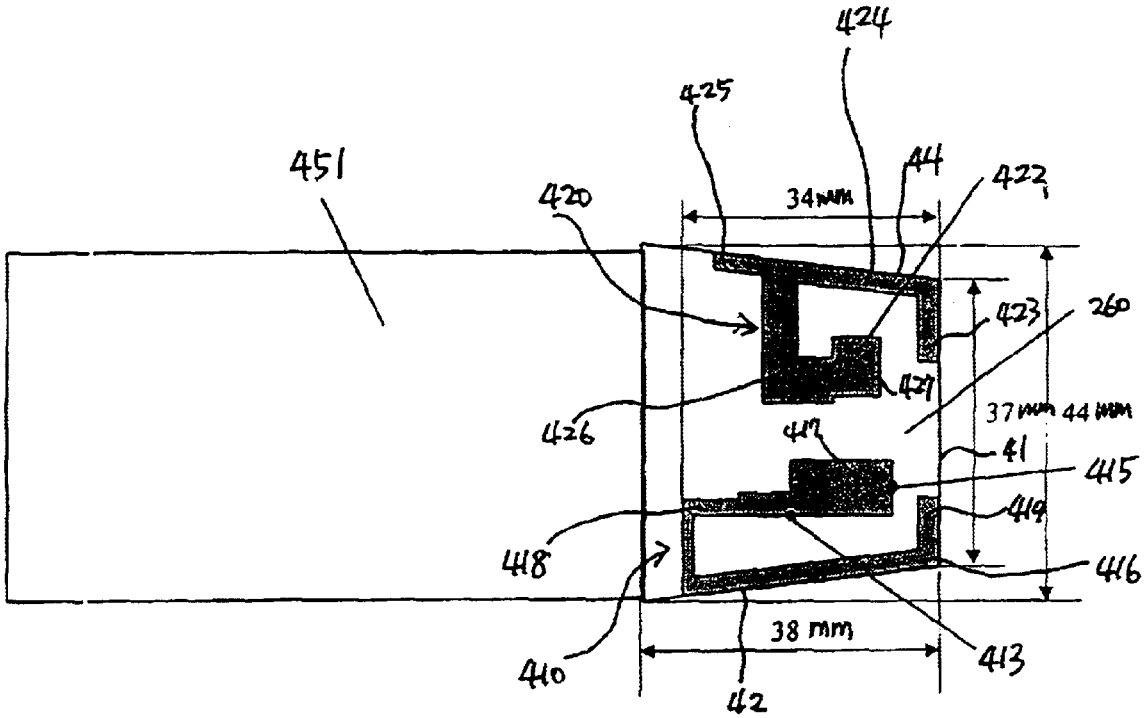
FIGS. 4*a* and 4*b* illustrate an exemplary antenna according to the present invention implemented on a mobile phone.
Figure 4B:
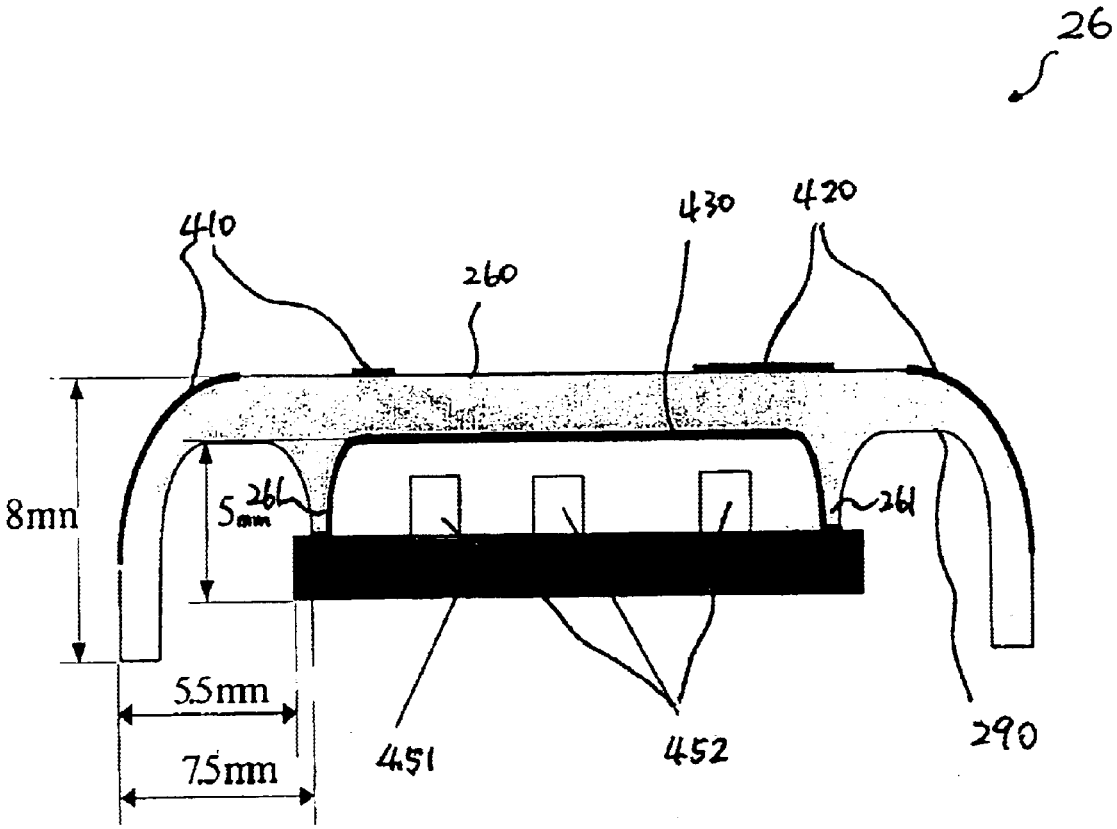

FIGS. 4*a* and 4*b* depict an exemplary antenna according to the present invention implemented on a mobile phone, such as that illustrated in FIGS. 2 and 3. The antenna is formed of conducting layers disposed, on the lower cover 26 of a mobile phone by means of photolithography.

Referring to FIG. 4*a*, the antenna has a first radiating segment 410 and a second radiating segment 420 disposed on the outside surface 260 of the lower cover 26. The first radiating segment 410 includes a first conductive strip 416 and a second conductive strip 418. The first conductive strip 416 has a substantially L shape with one leg disposed substantially parallel to and along the first side 41 and the other leg disposed substantially parallel to and along the second side 42 of the lower cover 26. The first conductive strip 416 has a free end 419 disposed near the first side 41.

The second conductive strip 418 also has a substantially L shape with one leg connected to the first conductive strip 416 near the second side 42 and the other leg having a free end 417 extending towards the first side 41. A rectangular conductive layer is formed at the free end 417.

The second radiating segment 420 of the antenna is also disposed on the outside surface of lower cover 26 and includes third and fourth conductive strips 424, 426. The third conductive strip 424 is of substantially L shape having one leg disposed along the first side 41 and the other leg disposed along the fourth side 44. The third conductive strip 424 has two free ends 423, 425.

The fourth conductive strip 426 is also of substantially L shape having one leg connected to the third conductive strip 424 near the fourth side 44 and the other leg having a free end 427 extending towards the first side 41. A substantially rectangular conductive layer is formed on the free end 427. In one aspect, the antenna elements disposed on the outer surface of the lower cover may be covered with a plastic layer or insulating paint coating.

In operation, the first radiating segment may be sized and configured to radiate in a low frequency band, such as from 890 MHz to 960 MHz, while the second radiating segment may be sized and configured to radiate in a high frequency band, such as from 1.7 GHz to 2.0 GHz. Other different frequency bands can also be used depending on design preferences and system requirements.

FIG. 4*b* is a cross-sectional view of lower cover 26 with the antenna described in FIG. 4*a*. A circuit board 451 having communication components 452 disposed thereon is attached to the lower cover 26. The lower cover 26 has an outside surface 260 and an inside surface 290. The lower cover 26 has housing components 261 configured to attach to circuit board 451 when one is installed inside the housing. Radiating segments 410, 420 are disposed on the outside surface 260. An inner conductive layer 430 is formed on the inside surface 290 extending to the tips of housing components 261. The inner conductive layer 430 forms signal communication, such as metallic contact, with the circuit board 451. The conductive layers disposed on the tips of housing components 261 contact circuits on the circuit board 451 when the board is installed in the housing. In one aspect, the inner conductive layer 430 forms a tunnel-shaped shield over the communication components 452.

The inner conductive layer 430 is in signal communication with the radiating segments 410 and 420. Referring to FIGS. 4*a* and 4*b*, matching points are disposed on the radiating segments respectively by forming metalized holes (vias) 413 and 422 to connect the radiating segments with the inner conductive layer 430. The first radiating segment 410 also includes a metalized hole 415 to connect to the ground. For example, the metalized hole 415 may connect to the inner conductive layer 430 and in turn form electric contact with the ground on the circuit board or the housing.

As illustrated, an exemplary antenna according to the invention may be disposed in the bottom half of the lower cover 26. Thus, the mobile phone user is less likely to touch the antenna during operation. Consequently, signal interference caused by human contacts is eliminated.

Figure 5A:
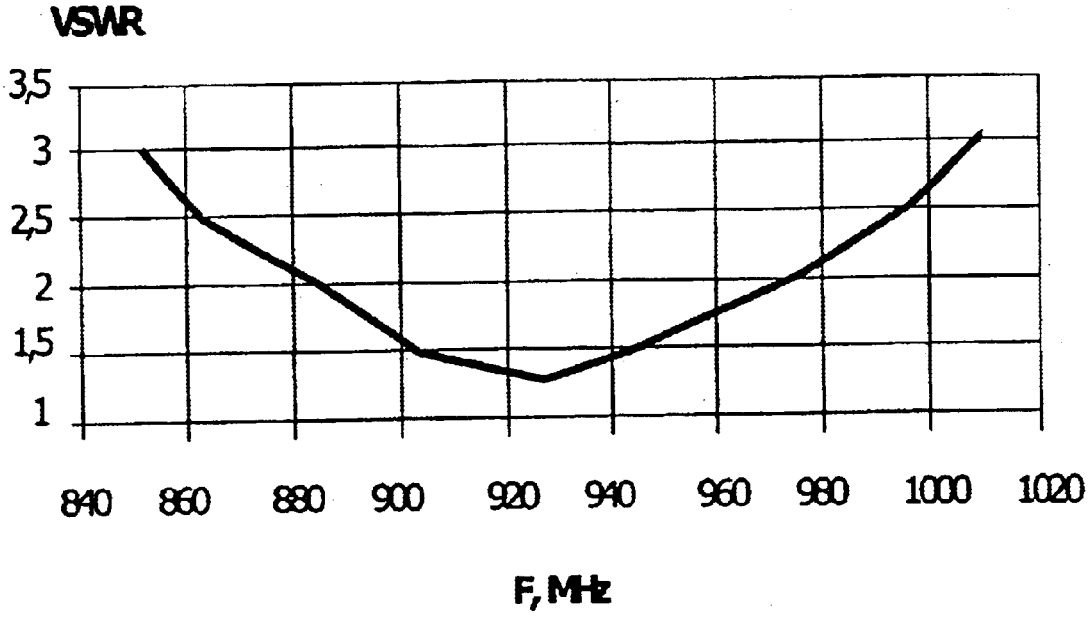
FIGS. 5*a* and 5*b* are VSWR (Voltage Standing Wave Ratio) curves relative to frequencies of an exemplary antenna according to the invention.
Figure 5B:
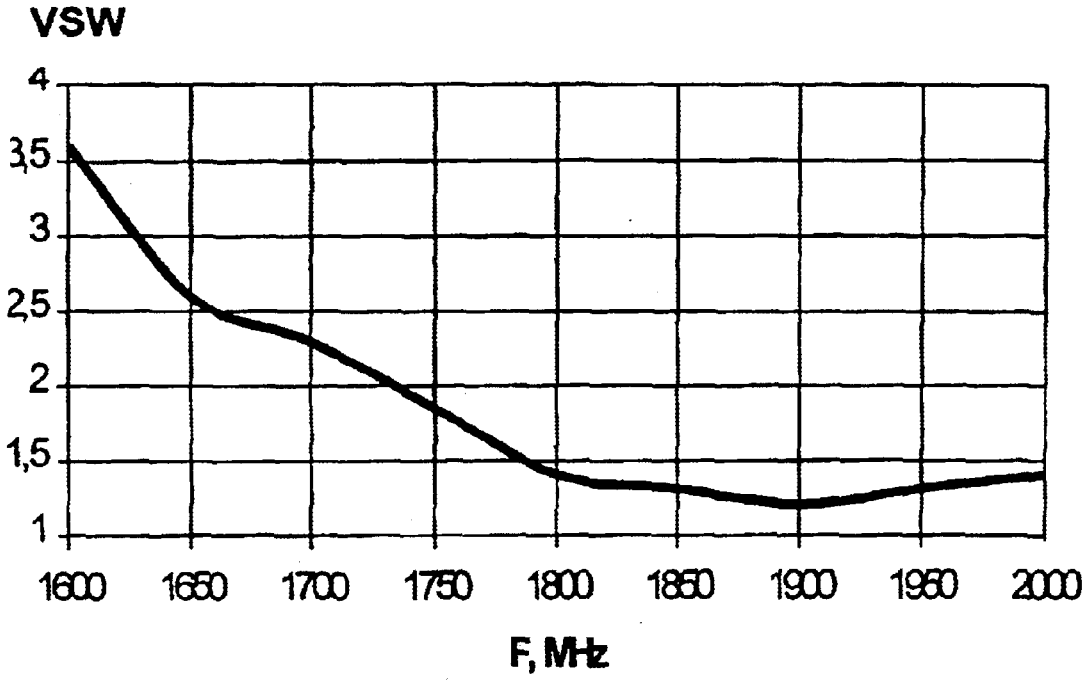
Figure 6A:
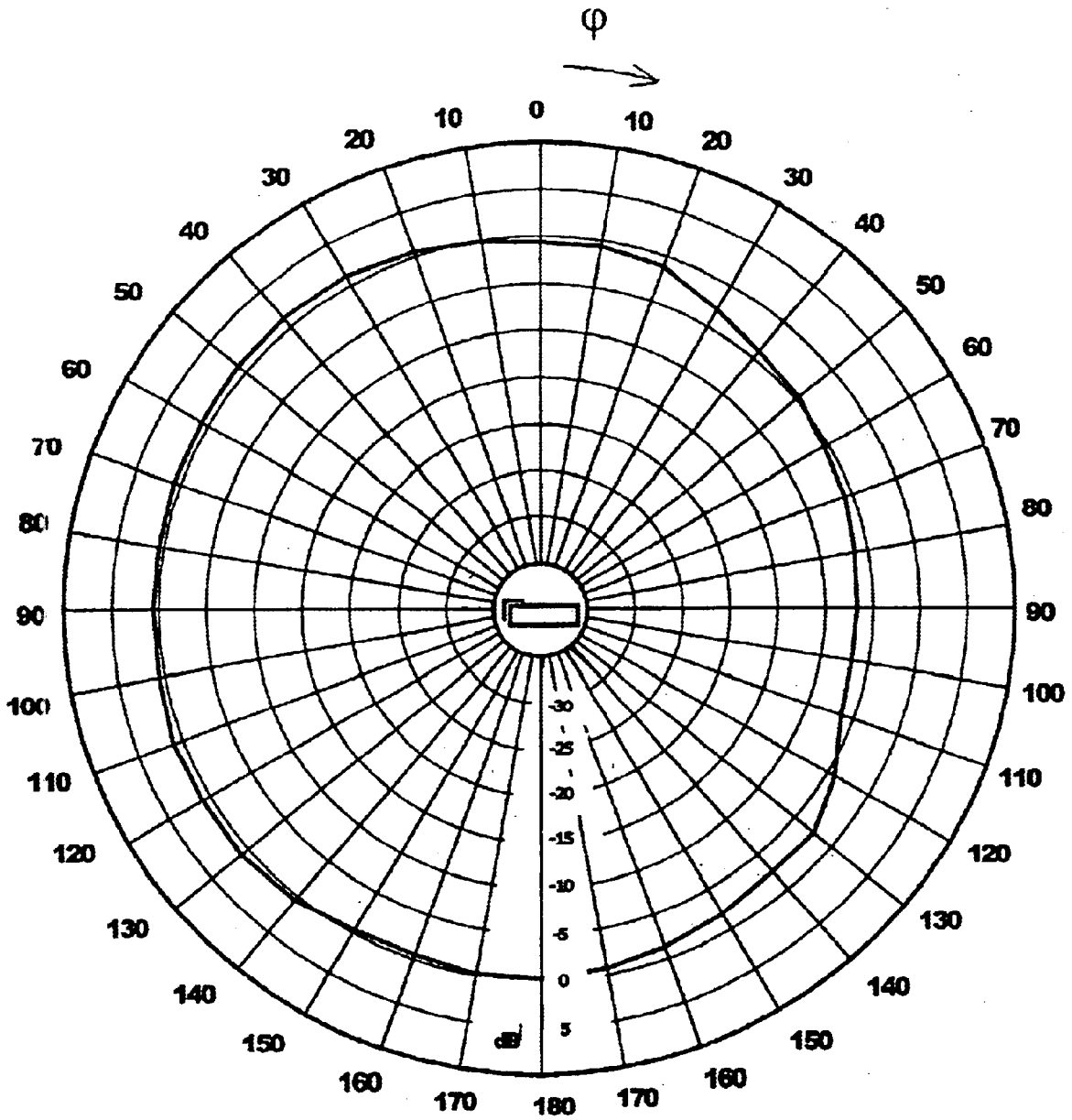
FIGS. 6*a*–6*e* depict radiation patterns of the antenna in different frequencies.
Figure 6B:
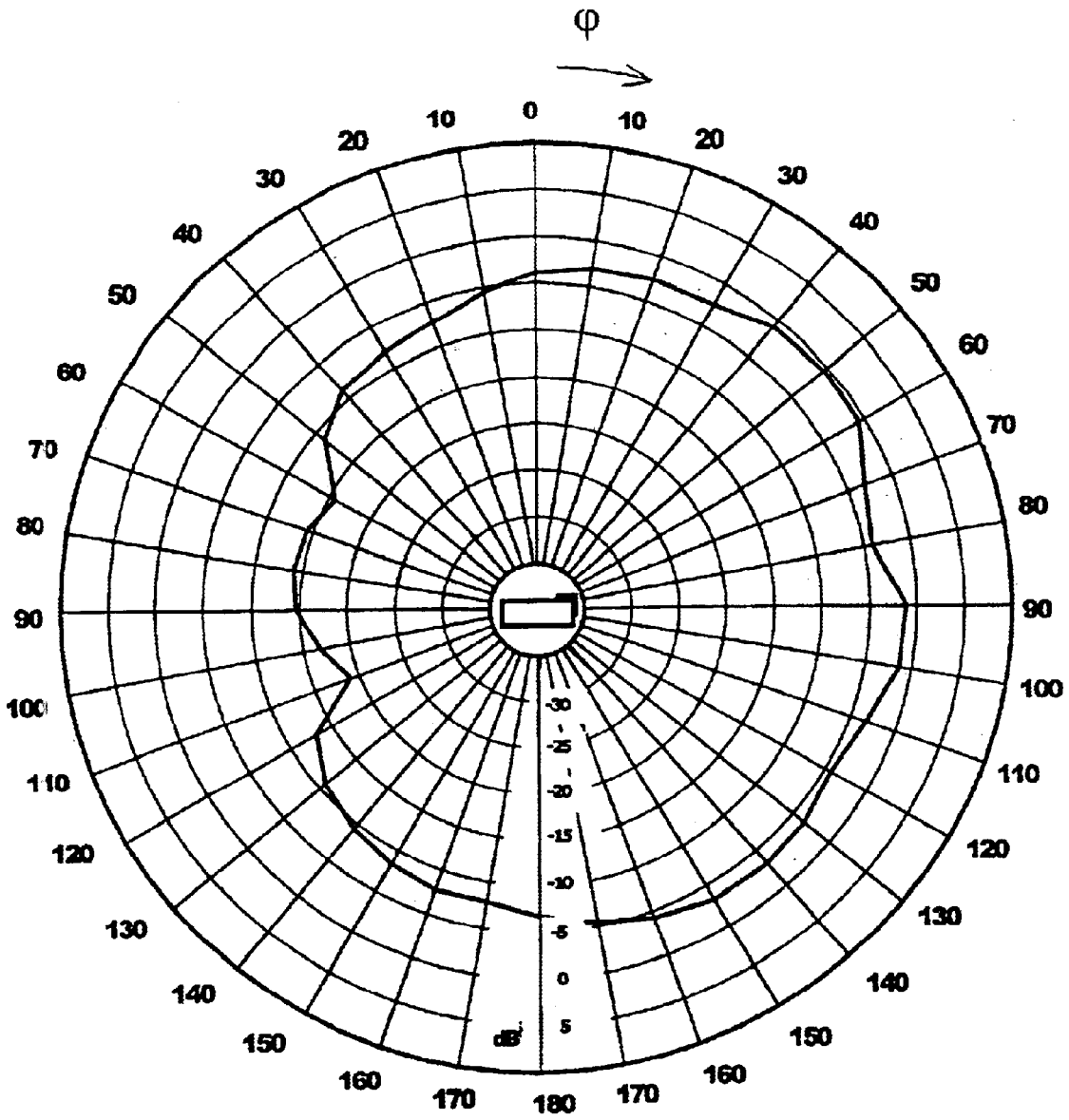
Figure 6C:
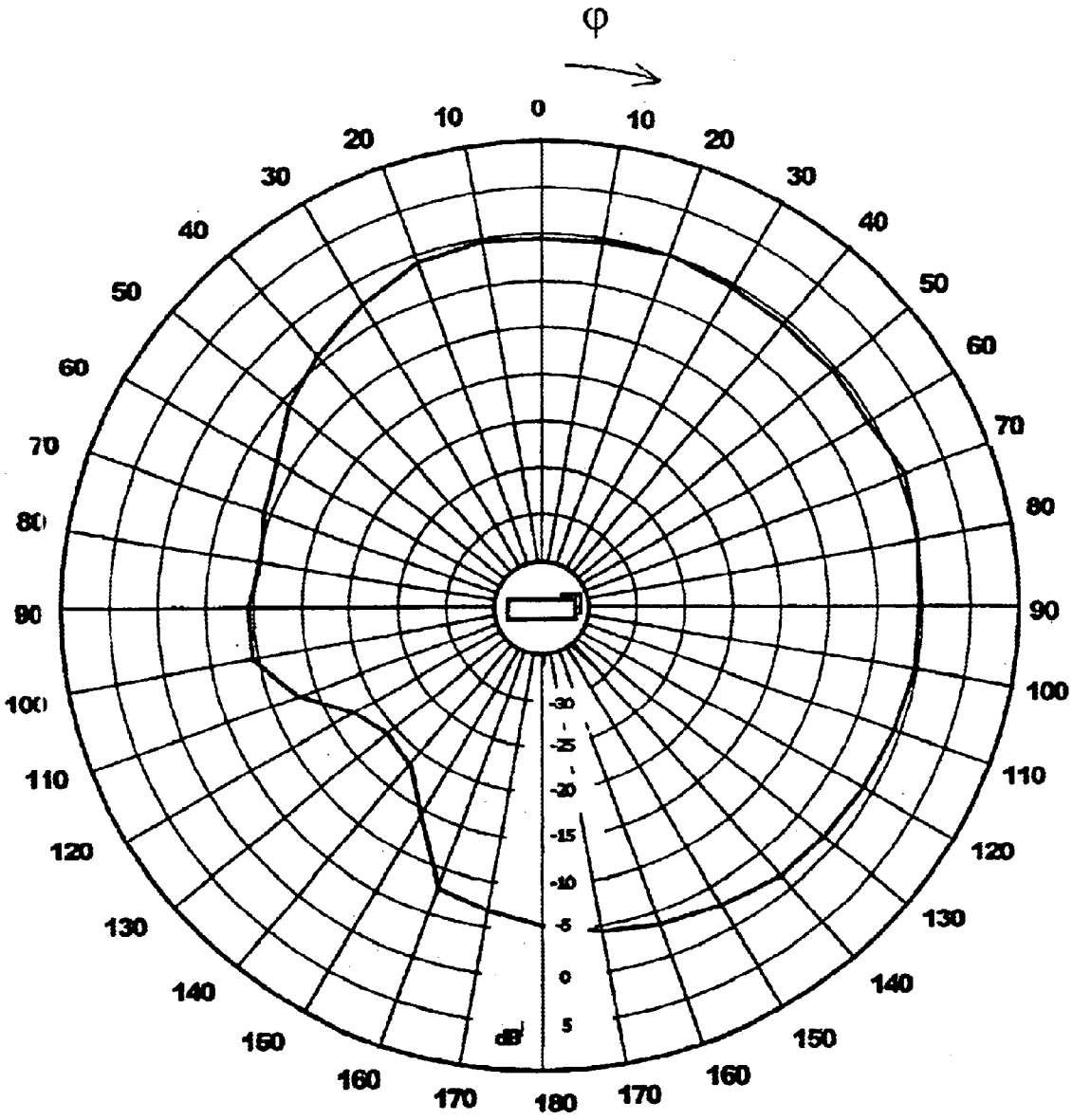
Figure 6D:
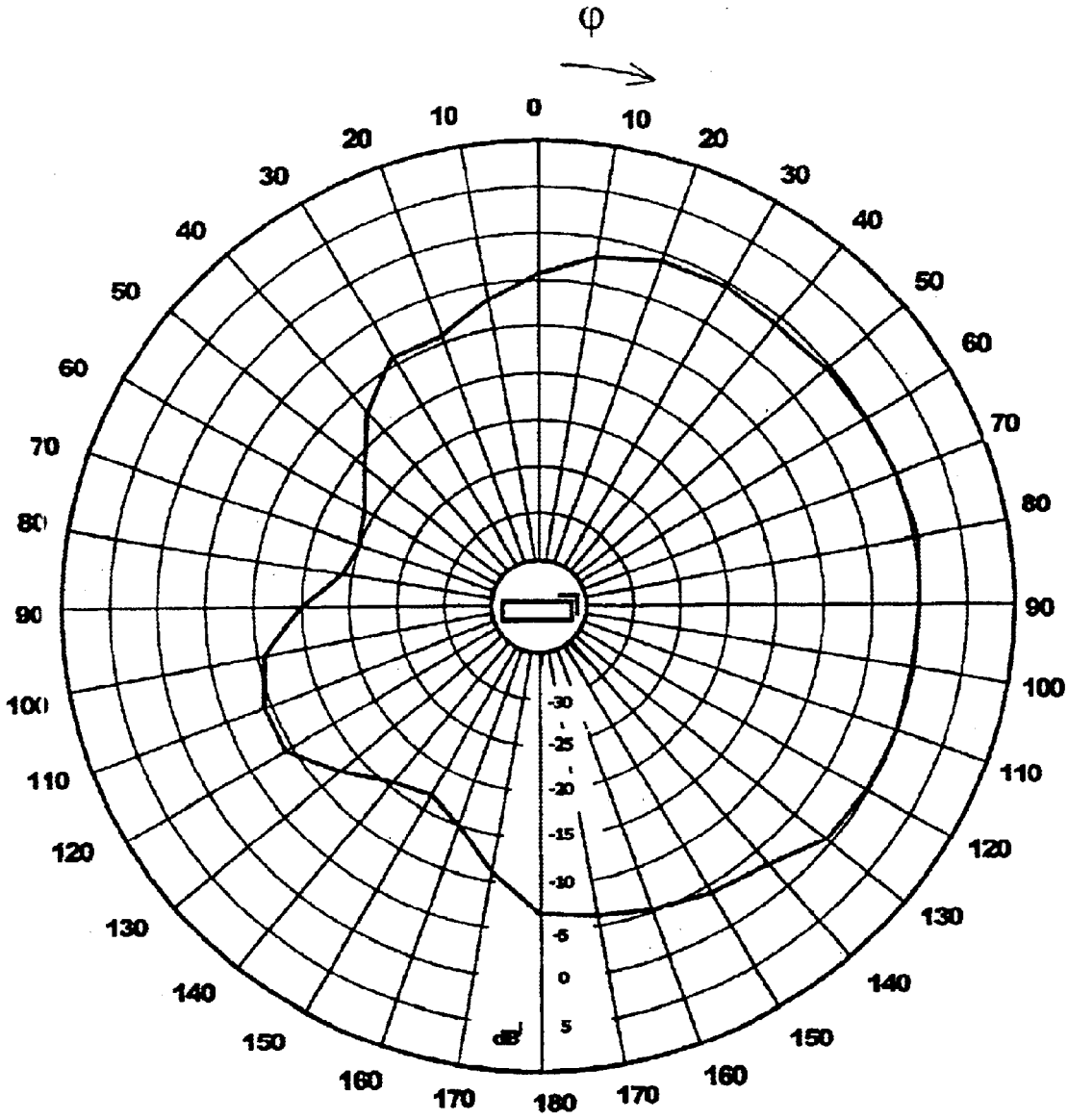
Figure 6E:
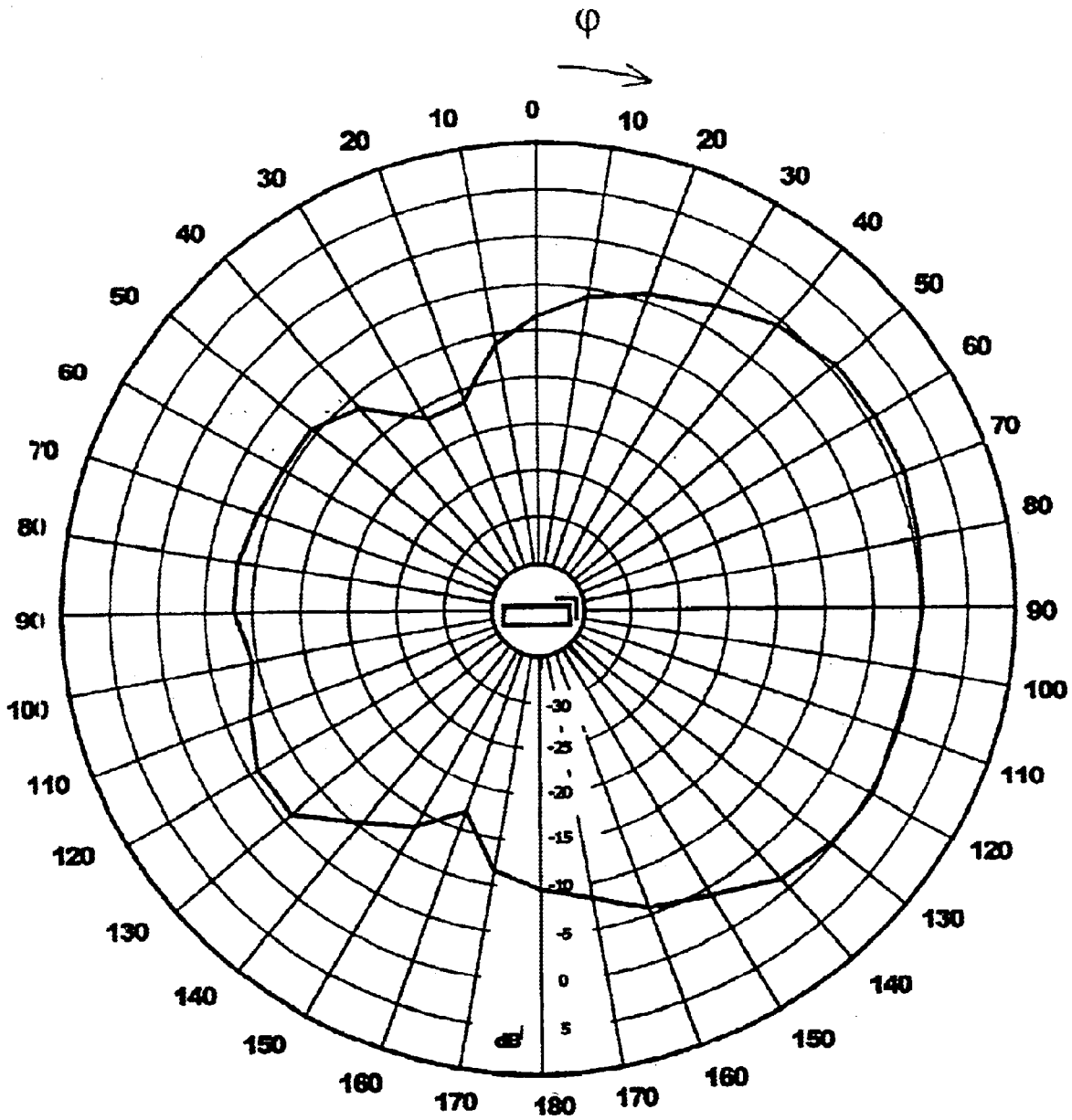

The antenna discussed above provides good signal qualities. One index for evaluating antenna performance is Voltage Standing Wave Ratio (VSWR). VSWR relates to the impedance match of an antenna feed point with a feed line or transmission line of a communications device, such as a mobile phone. Generally, VSWR values less than 2.0 are preferable. FIGS. 5*a* and 5*b* show VSWR. (Voltage Standing Wave Ratio) curves of the antenna described above. The VSWR curves of the antenna illustrate excellent VSWR characteristics spanning from 890 MHz to 970 MHz and 1700 MHz to 2000 MHz. Thus, the antenna can operate in a plurality of frequency bands. FIGS. 6*a*–6*e* depict radiation patterns of the antenna in FIGS. 4*a* and 4*b* in different frequencies.

According to another aspect of the invention, the antenna described in FIG. 4*a* can also be formed on a substrate, such as dielectric substrate made of FR4 or polyimide. Other materials known to people skilled in the art may be used for the substrate. The antenna and the substrate combined become an antenna module.

In one aspect, the antenna module may be implemented as an independent component to be mounted inside the housing. As discussed above, when the circuit board is mounted in the housing, the antenna module forms signal communication via electric contacts.

In another aspect, the antenna module may be disposed on a flip panel of a mobile phone. The flip panel attaches to the mobile phone housing with hinges. In operation, the flip panel may be pivoted by a user about the hinges between open and closed positions. When the flip panel is in the closed position, the panel may provide protection to the keys from unintentional activation. When the panel is in the open position, the panel may provide a convenient extension to the mobile phone. When the panel is fitted with a microphone, the microphone can be favorably positioned to receive a voice signal input from a user.

The antenna must couple to the circuit board of the mobile phone in order to transmit signals therebetween. A fine wire or plastic strip containing conducting wires may be used to connect the matching points and ground point to the circuit board and the housing. Other design options for conducting signals between the circuit board and the antenna known to people skilled in the art may also be used.

While certain descriptions in the above illustrate the invention based on the first and second radiating segments, any type of antennas can be used in combination with the inner conductive layer and the mobile phone housing to provide a multiple frequency band antenna. It is understood by people skilled in the art that the antenna configuration may be altered so that the antenna performs differently to suit specific frequencies and purposes of use. Therefore, the sizes and positions of the conductive layers can be manipulated to obtain optimized transmission and receiving qualities. The shape of the conducting sections can also be altered as well.

Antennas according to the invention may also be used with communications devices that only transmit or only receive radio frequency signals. Such devices that only receive signals may include conventional AM/FM radios or any receiver utilizing an antenna. Devices that only transmit signals may include remote data input devices.

Those skilled in the art will recognize, or be able to ascertain using no more than routine experimentation, many equivalents to the specific embodiments of the invention specifically described herein. Such equivalents are intended to be encompassed in the scope of the following claims.

What is claimed is:

1. An asymmetrical antenna, comprising:

a substrate having opposite first and second surfaces, and first, second, third, and fourth sides;

a first radiating segment disposed on the first surface of the substrate, including:

a first conductive strip of substantially L shape disposed along the first and second sides of the substrate; and a second conductive strip of substantially L shape having one end connected to the first conductive strip near the second side of the substrate and one free end extending toward the first side of the substrate; and a second radiating segment disposed on the first surface of the substrate, including:

a third conductive strip of substantially L shape disposed along the first and fourth sides of the substrate; and a fourth conductive strip of substantially L shape having one end connected to the third conductive strip near the fourth side of the substrate and one free end extending towards the first side of the substrate.

2. The asymmetrical antenna of claim 1, wherin the second conductive strip forms a quadrangular conductive layer at the free end.

3. The asymmetrical antenna of claim 1, wherein the third conductive strip has two free ends.

4. The asymmetrical antenna of claim 1, wherein the antenna is connected to a ground via a conducting element disposed on the free end of the second conductive strip.

5. The asymmetrical antenna of claim 1, wherein the antenna is sized and configured to work in a low frequency band and a high frequency band.

6. The asymmetrical antenna of claim 5, wherein the first radiating segment is sized and configured to work in the low frequency band and the second radiating segment is sized and configured to work in the high frequency band.

7. An antenna module formed on a housing for a circuit board having communication components disposed thereon, comprising:

a housing element having opposite first and second surfaces, and first, second, third, and fourth sides;

a first radiating segment disposed on the first surface of the housing element, including:

a first conductive strip of substantially L shape disposed along the first and second sides of the housing element; and a second conductive strip of substantially L shape having one end connected to the first conductive strip near the second side of the housing element and one free end extending towards the first side of the housing element;

a second radiating segment disposed on the first surface of the housing element, including:

a third conductive strip of substantially L shape disposed along the first and fourth sides of the housing element; and a fourth conductive strip of substantially L shape having one end connected to the third conductive strip near the fourth side of the housing element and one free end extending towards the first side of the housing element; and an inner conductive layer disposed on the second surface of the housing element electrically connected to the first and second radiating segments;

wherein the inner conductive layer is configured to form signal communication with the circuit board when the circuit board is mounted in the housing.

8. The antenna module of claim 7, wherein the second conductive strip forms a quadrangular conductive layer at the free end.

9. The antenna module of claim 7, wherein the third conductive strip has two free ends.

10. The antenna module of claim 7, wherein the antenna module is sized and configured to work in a low frequency band and a high frequency band.

11. The antenna module of claim 10, wherein the first radiating segment is sized and configured to work in the low frequency band and the second radiating segment is sized and configured to work in the high frequency band.

12. The antenna module of claim 7, wherein the inner conductive layer forms a conductive shield over the communication components disposed on the circuit board when the housing receives the circuit board.

13. The antenna module of claim 7, wherein the first and second radiating segments are connected to the inner conductive layer via a connecting element.

14. The antenna module of claim 13, wherein the connecting element includes a plurality of metalized holes.

15. The antenna module of claim 7, wherein the inner conductive layer forms an electrical contact with the circuit board when the circuit board is received by the housing.

* * * * *